United States Patent [19]

Zuercher

[11] Patent Number: 5,053,592

[45] Date of Patent: Oct. 1, 1991

[54] LOW CURRENT SWITCHING APPARATUS HAVING DETENT STRUCTURE PROVIDING TACTILE FEEDBACK

[75] Inventor: Joseph C. Zuercher, Brookfield, Wis.

[73] Assignee: Eaton Corporation, Cleveland, Ohio

[21] Appl. No.: 486,570

[22] Filed: Feb. 28, 1990

[51] Int. Cl.[5] ..... H01H 21/00

[52] U.S. Cl. ..... 200/553; 200/5 A; 200/339; 200/409; 200/517; 200/557

[58] Field of Search ..... 200/517, 553, 556, 557, 200/339, 315, 5 A, 1 V, 406, 409, 516

[56] References Cited

U.S. PATENT DOCUMENTS

| | | | |
|---|---|---|---|
| 4,056,700 | 11/1977 | Stannek | 200/5 A X |
| 4,065,651 | 12/1977 | Erni et al. | 200/409 X |
| 4,340,791 | 7/1982 | Sorenson | 200/315 X |
| 4,400,596 | 8/1983 | Fukukura et al. | 200/517 X |
| 4,480,292 | 10/1984 | Schuder | 200/315 X |
| 4,490,587 | 12/1984 | Miller et al. | 200/5 A |
| 4,611,261 | 9/1986 | Suwa | 200/516 X |
| 4,710,602 | 12/1987 | Barty et al. | 200/315 |
| 4,916,262 | 4/1990 | Jungles-Butler et al. | 200/5 A |
| 4,918,264 | 4/1990 | Yamamoto et al. | 200/5 A X |
| 4,929,804 | 5/1990 | Kamai et al. | 200/5 A |
| 4,931,605 | 6/1990 | Zoller | 200/406 X |

FOREIGN PATENT DOCUMENTS

| | | | |
|---|---|---|---|
| 3211965 | 10/1983 | Fed. Rep. of Germany | 200/409 |
| 3441614 | 7/1985 | Fed. Rep. of Germany | 200/517 |

*Primary Examiner*—Henry J. Recla

*Assistant Examiner*—Glenn T. Barrett

*Attorney, Agent, or Firm*—L. G. Vande Zande

[57] ABSTRACT

Pivotal movement of a switch actuator drives a finger projecting from the actuator against a convexly bowed leaf spring, depressing an intermediate portion of the leaf spring to an unstable concave condition. The leaf spring resists the actuator movement, initially with an increasing force but changing to a decreasing force at a predictable point in actuator movement to provide tactile feedback at an operator affixed to the actuator. The leaf spring is a flat beam. The spring foce and point of changeover can be readily and predictably varied during manufacture by selecting springs having different widths, thicknesses or other variable parameters. A modular block holds the spring in the bowed condition and is positioned relative to the actuator finger by a support plate. The actuator finger drives the spring against a conductive rubber block, compressing the block against spaced conductors on a printed circuit to complete the circuit. A plurality of such switches are made in a common package by layering a printed circuit, insulator sheet, conductive rubber sheet with raised bosses, detent support plate and a plurality of detent blocks with bowed springs, between a base and a cover. Back lit illumination is provided by a light pipe trapped against the cover as an additional layer. A microprocessor board, connected to the internal printed circuit, is attached to the switch housing exteriorly of the base.

37 Claims, 6 Drawing Sheets

FIG 5
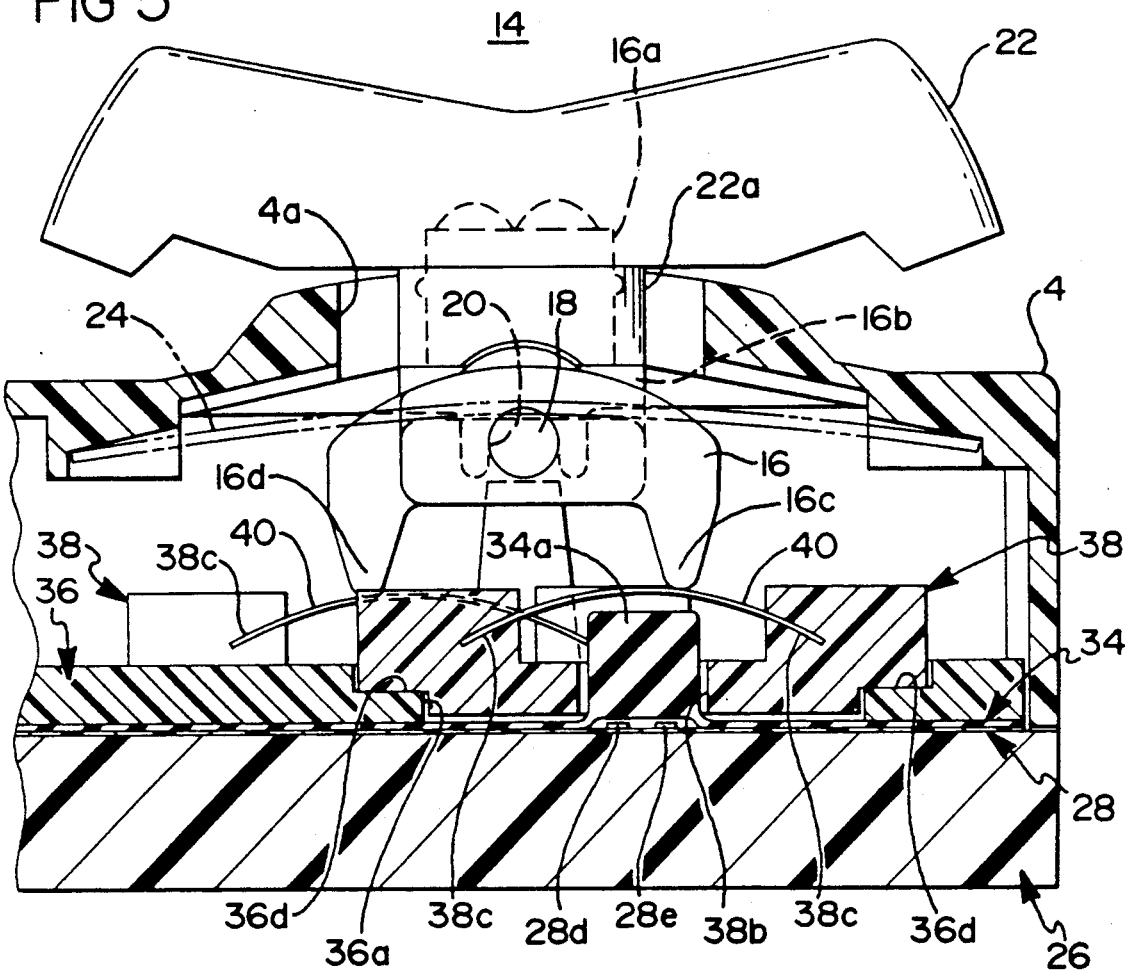
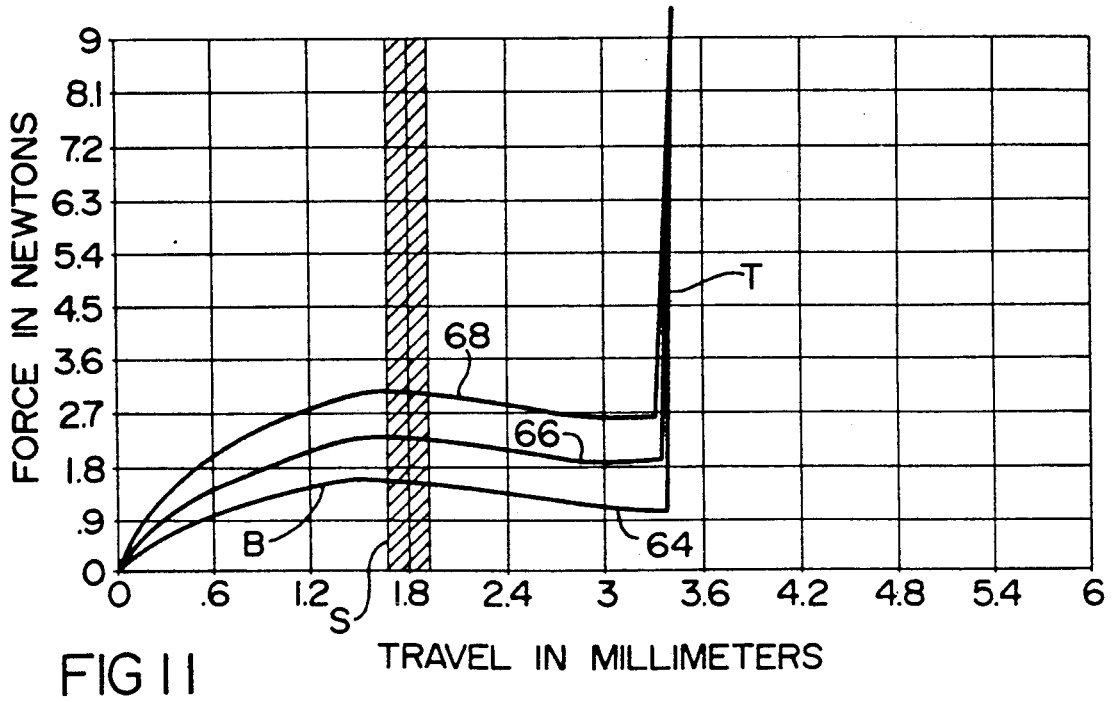
FIG 11

LOW CURRENT SWITCHING APPARATUS HAVING DETENT STRUCTURE PROVIDING TACTILE FEEDBACK

BACKGROUND OF THE INVENTION

This invention relates to switching apparatus for low current switching, e.g. microprocessor level signals. More particularly, this invention relates to such apparatus having a detent structure which provides tactile feedback to the operator. Still more particularly, the invention pertains to improved detent apparatus wherein the tactile feedback can readily be varied during manufacture to assimilate that of power current switch apparatus.

The increasing use of computers has made multiplexing attractive in many consumer applications, and as a result, a need exists for switches interfaceable with microprocessor level signals. An automotive passenger car provides a good example of such application, although the switching apparatus of this invention is not limited to that application. Convenience functions in passenger cars such as the adjustment of windows, seats, mirrors, etc., are controlled by multiple switches ganged within a single package commonly located in the arm rest of a door. Such switches are designed to switch power directly to the actuators such as motors and solenoids for these items and require large, heavy cable harnesses to pass through the passenger door hinge area to be routed throughout the chassis and into other doors.

The state of the art passenger car has on-board computers for the monitoring and control of several operational functions of the engine and related components. Since the computer is already on-board, it is desirable to incorporate multiplexing of the convenience function controls with the computer. However, it is preferred to maintain the heavy duty feel, i.e. size, shape and detent characteristics, of the state of the art power switches presently being used, particularly in certain regions of the car such as the door arm rest. It is also desirable to provide such switch designs which can be readily and predictably varied during manufacture as to the tactile feedback provided in operation to meet varying specifications of the automobile manufacturers. Another feature to be considered is the capability for back lighting within the switch package that can provide a common look with the styling in other regions of the car. These features must be incorporated in a package that does not increase the footprint, i.e. the square inch surface area, and in many cases the depth and/or volume over present switches and that may be assembled at a competitive cost with present power switches which have been refined over a long time for mass production at low cost.

SUMMARY OF THE INVENTION

This invention provides low current switching apparatus having a detent for providing a tactilely discernible reduction-in-force feel to the operator, which detent can be readily and predictably changed during manufacture to provide greater or lesser force versus displacement reaction upon operation. The switching apparatus of this invention may comprise a single switch or a plurality of switches arranged in a unitary housing, assembled by stacking components in a layered manner. The switch contacts comprise spaced conductive elements of a printed circuit or the like which are bridged by a block of conductive rubber compressed thereagainst into a current conducting relationship upon switch operation. The detent structure comprises a modular block having opposed angular slots for firmly receiving the ends of one or more flat beam leaf springs to fixedly position the spring(s) in a bowed shape over a hole in an intermediate portion of the block. A separate detent support plate is provided with locating means for positioning a plurality of such modular detent blocks over respective switch contacts and in corresponding alignment with switch actuating means mounted in the cover of the unit. The force versus displacement characteristics may be predictably changed by providing alternative detent block and spring combinations wherein the parameters of spring material, thickness per beam, width, length, number of beams, clamp angle of the ends of the spring(s) and the initial arc height of the springs vary. By readily substituting the detent block assembly during assembly of the switch, more or less tactile feedback may be provided. Another parameter that can vary the tactile feedback is the travel path of the portion of the actuator that bears upon the spring. A light pipe member constitutes still another layer disposed between the interior of the cover and the detent support plate, the light pipe also functioning as a bearing support member, if necessary, for switch actuators. These and other features and advantages of this invention will become more readily apparent when reading the following description and appended claims in conjunction with the accompanying drawings.

BRIEF DESCRIPTION OF THE DRAWINGS

FIG. 5 is a cross sectional view through one switching element taken along the line 5—5 in FIG. 1 and drawn to an enlarged scale;

FIG. 11 is a force versus displacement graph for the operator of the switching apparatus of this invention;

DETAILED DESCRIPTION OF THE PREFERRED EMBODIMENT

By way of example, the low current switching apparatus of this invention is described in a convenience package switch embodiment for use in a passenger car door arm rest or the like, although it is to be understood that such switching apparatus may be used in other low current switching applications. With particular reference to FIGS. 1–3 and 5 of the drawings, a convenience switch package 2 comprises a molded insulating cover 4 to which actuator/operator assemblies for five switches 6–14 are pivotally attached. Switch 6 is a two-position lockout switch which, when the switch package 2 is used as a window control, may be operated to prevent local operation of remote door windows. The particular detent structure for the two-position switch 6 is different from the detent structure to be described in conjunction with this invention, and therefore switch 6 is not described in detail herein. The switches 8–14 are identical and therefore only switch 14 will be described in detail.

Figure 1:
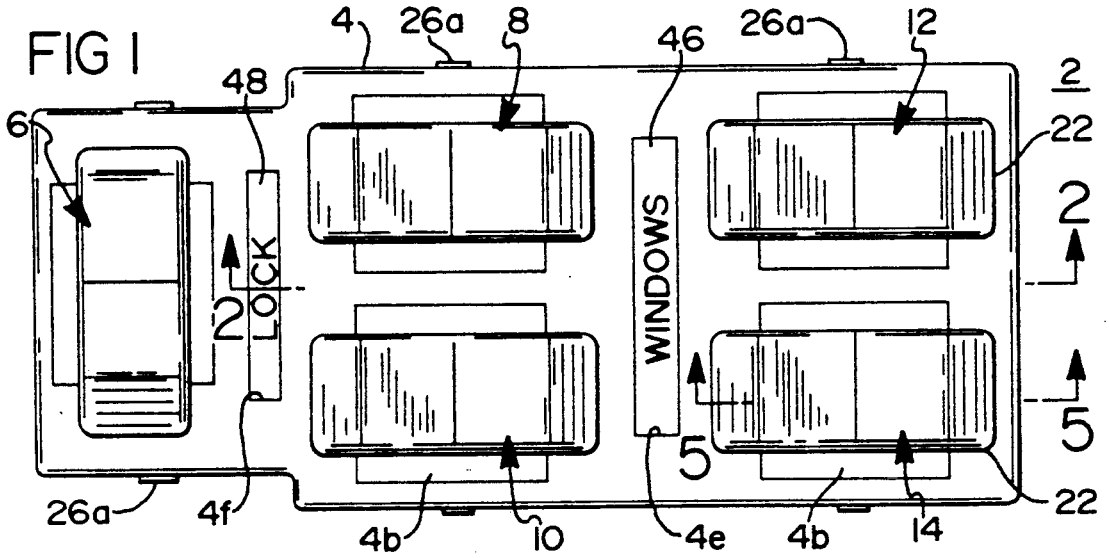
FIG. 1 is a plan view of a multiple switch low current switching apparatus constructed in accordance with this invention.
Figure 2:
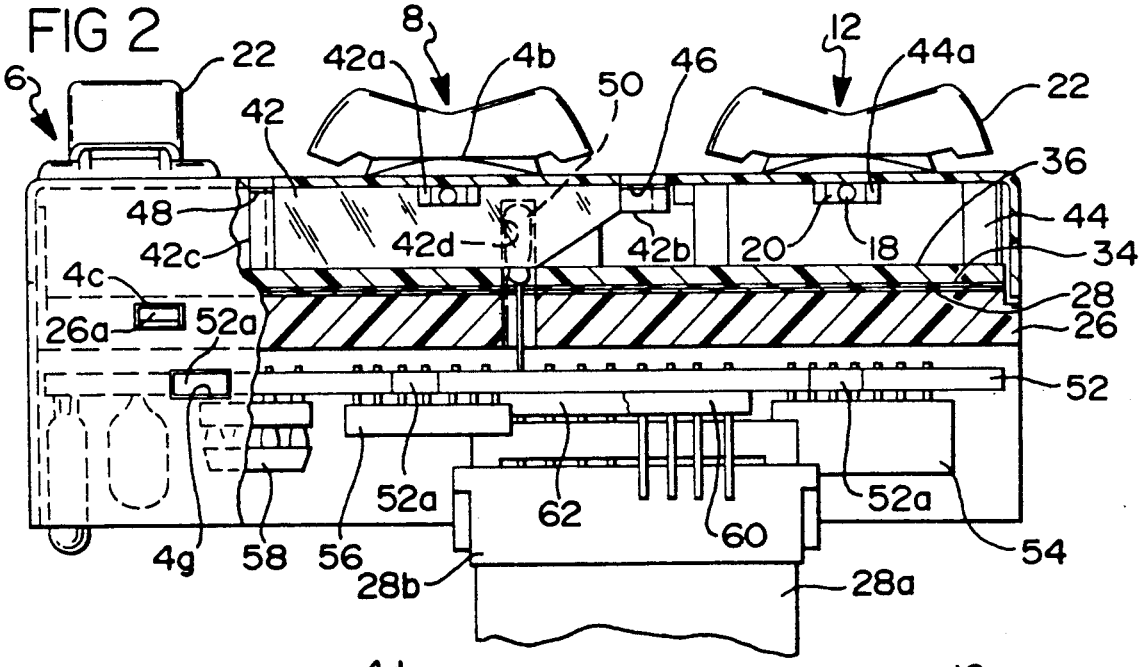
FIG. 2 is a cross sectional view taken substantially along the line 2—2 in FIG. 1.
Figure 3:
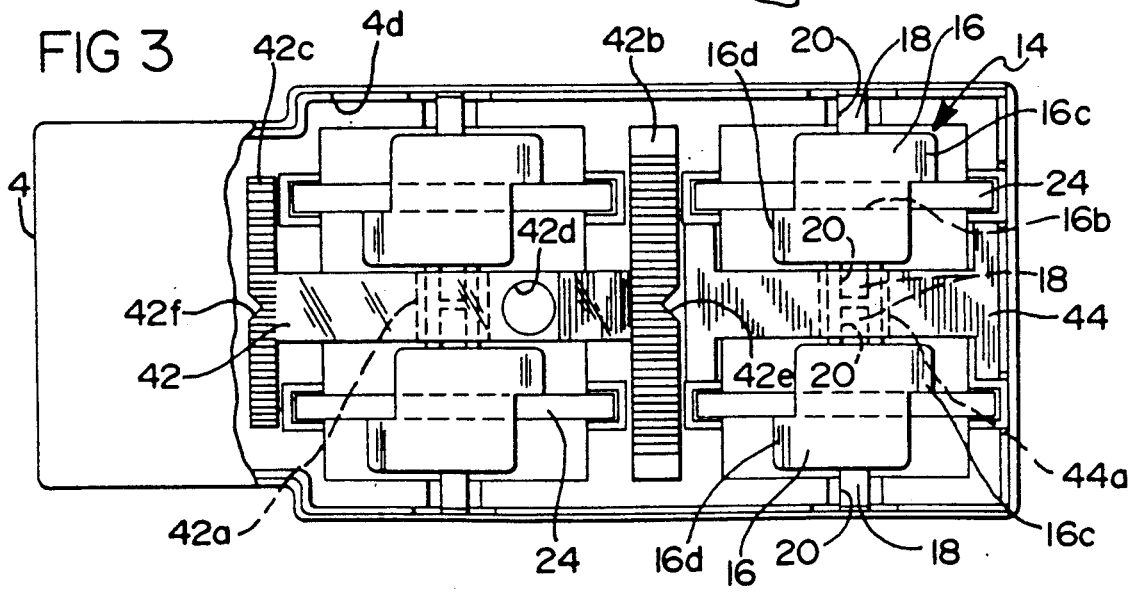
FIG. 3 is a bottom view of the cover and switch actuators of the apparatus shown in FIG. 1.

Referring particularly to FIGS. 3 and 5, an actuator 16 having trunnions 18 is pivotally supported in semicylindrical bearing journals 20 formed on the interior of cover 4, the journals 20 being open to the bottom. Actuator 16 has a peg **16*a* projecting through an opening 4*a* in cover 4. A rocker button 22 has a hollow stem 22*a* which is pressed onto peg 16*a* to assemble button 22 to actuator 16. As seen in FIG. 2, the lower lateral edges of rocker button 22 rest upon a crowned formation 4*b* on cover 4 for rocking movement thereon in conjunction with pivoting of the actuator 16 within the journal 20. Actuator 16 has a hole 16*b* extending therethrough transversely to the axis of trunnions 18 through which a leaf spring 24 may extend as seen in FIG. 3 and in dot-dash line in FIG. 5. Spring 24 functions to maintain actuator 16 in its center position. As will be noted hereinafter, the detent structure of this invention functions to bias actuator 16 to the center position and therefore spring 24 is not necessary. Actuator 16 also comprises a pair of fingers 16*c* and 16*d* extending in opposite directions from the axis of trunnions 18 and from opposite lateral sides of the actuator as seen in FIG. 3**. As thus far described, the cover and actuator/operator assemblies represent a state of the art structure used in higher current switches which switch power directly to the window motors.

Figure 4:
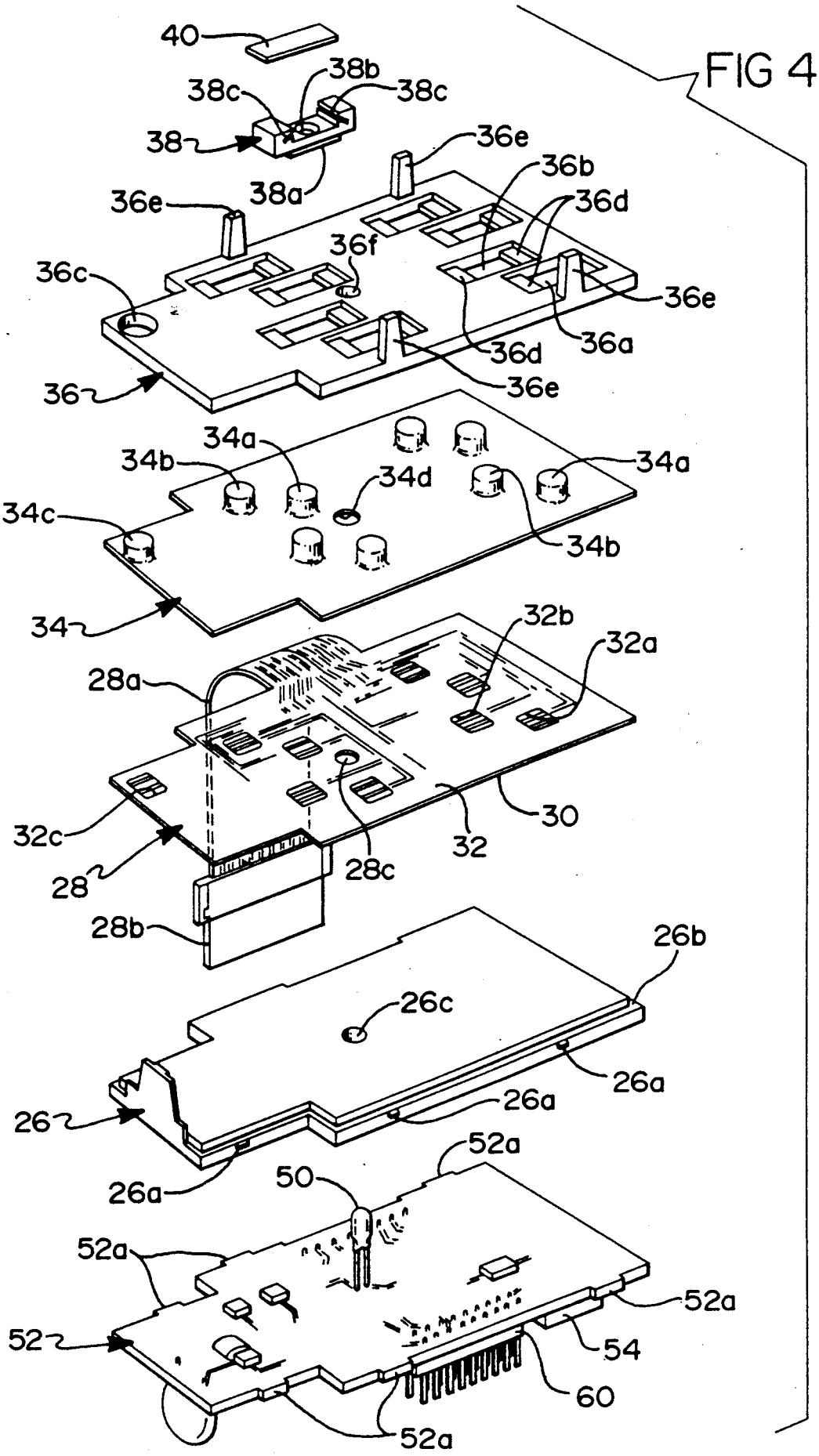
FIG. 4 is an exploded isometric view of components of the switching apparatus of this invention which are assembled in a layered arrangement.

The switching apparatus of this invention is particularly designed to switch microprocessor level signals. The contacts for the respective switches comprise spaced conductive elements of a printed circuit which are bridged by pressing a conductive elastomer block thereagainst. Referring particularly to FIG. 4, the switch components for all five switches of convenience switch package 2 are provided on common elements which constitute a layered assembly of the switch of this invention. A molded insulating base 26 provides a support layer. A printed circuit is embodied in a planar switch 28 which rests upon a flat upper surface of base 26. The printed circuit is formed on a flexible substrate such as a Mylar sheet 30 and is covered by an insulator film 32 which may be a discrete element or applied directly to the printed circuit and Mylar sheet. Insulator 32 is provided with a plurality of openings **32*a*, 32*b* arranged in pairs aligned with the respective switches 8–14 and a single opening 32*c* at the left-hand end as seen in FIG. 4, which is in alignment with switch 6. Each of the openings 32*a*, 32*b* and 32*c* expose spaced conductive elements of the printed circuit which comprise stationary contacts of the respective switches. Planar switch 28 has a flexible ribbon conductor 28*a* extending therefrom having a multiple pin connector 28*b*** attached at the end thereof.

Bridging contact elements of the switching apparatus of this invention comprise a conductive elastomer block disposed over the conductive switch contact elements on planar switch 28 and compressed thereagainst to effect current conduction. The conductive elastomer comprises a polymer or rubber material which incorporates a high concentration of filamentary conductive material into the otherwise electrical insulating material. The electrical properties of these materials are usually defined in terms of volume and surface resistivity. Such properties rely on the meshwork of conductive material and the pressure applied thereon. The conductive bridging contact may be formed as a molded sheet of rubber or polymer 34 which has a plurality of pairs of bosses **34*a* and 34*b* aligned with the switch contacts defined by the respective openings 32*a*, 32*b* of the planar switch 28. The entire sheet 34 may be made of conductive rubber or polymer or it may be made of an electrically insulating rubber or polymer coated at the undersurface of the bosses 34*a* and 34*b* with the aforementioned conductive rubber or polymer. Alternatively, any conductive material could be bonded to the undersurface of bosses 34*a* and 34*b*. Still another alternative is to provide individual blocks of conductive rubber or polymer positioned over the respective switch contacts. A single boss 34*c* is formed at the left-hand end as viewed in FIG. 4 and is aligned with the contacts defined by opening 32*c*** on the planar switch.

A molded plastic detent support plate 36 is disposed on the elastomer sheet 34. Support plate 36 is provided with a plurality of pairs of offset rectangular apertures **36*a*, 36*b* into which the respective bosses 34*a*, 34*b* of elastomer sheet 34 project. The left-hand end of support plate 36 has a hole 36*c* into which boss 34*c* projects. The opposite ends of rectangular apertures 36*a*, 36*b* are provided with recessed shelves 36*d* which combine with the rectangular outline of the respective aperture to locate modular detent blocks 38 therein. The detent blocks 38, only one of which is shown in FIG. 4, are molded of insulating material and have a rectangular outline complementary to the shape of apertures 36*a*, 36*b* and are positioned therein with the opposite ends resting on the shelves 36*d*. The block 38 is provided with a depending central portion 38*a* which is disposed between the shelves 36*d* within the respective apertures. It is also provided with a hole 38*b* which extends upward through the center of the block to surround the respective boss 34*a*, 34*b* of elastomer sheet 34. The upper surface of the intermediate portion of detent block 38 is recessed to provide a pair of opposed upstanding surfaces which have slots 38*c* formed therein. The slots 38*c* are formed at opposite angles which converge over the intermediate portions of the detent block to define an obtuse angle therebetween. A flat beam leaf spring 40 is assembled to the detent block 38 in a bowed condition by sliding the opposite ends of the spring 40 into the respective slots 38*c*. The relative dimensions of the slot and spring thickness are preferably selected to permit the spring to be slid into the slot from the side to minimize stress in the spring at the entry point while maintaining a firm fit between these members. Each of the apertures 36*a*, 36*b* receives a detent block 38 and leaf spring 40 assembly therein. As will be discussed hereinafter, the angle of the slots 38***c*, the distance between the ends of those slots, and the length, thickness, width, material and number of springs are parameters which may be varied as well as the path of the operator-/actuator to produce individual detent block assemblies which provide different tactile feedback qualities to the operator.

The multi-layer assembly comprising base 26, planar switch 28 having insulator 32 integral therewith, conductive rubber sheet 34, detent support plate 36 and the respective assemblies comprising detent blocks 38 and springs 40, is snapped into place within cover 4 by tabs 26*a* on base 26 which snap into rectangular holes 4*c* (FIG. 2) in cover 4. Base 26 is provided with a peripheral step 26*b* which engages a complementary shoulder 4*d* (FIG. 3) within cover 4 to positively locate base 26 to the cover 4. When so assembled, fingers 16*c* and 16*d* bear upon the leaf springs 40 of the respective detent blocks 38, the leaf springs supplying an initial bias of the actuator 16 to its center position and holding the trunnions 18 within the journals 20. Support plate 36 is also provided with four upstanding bearing posts 36*e* which align with the journals 20 in the peripheral wall of cover 4 to close off the open side of the respective journals 20. The heights of posts 36*e* may be closely dimensionally controlled with respect to the depth of shelves 36*d* for precisely positioning the detent blocks 38 and springs 40 with respect to the actuator 16. Moreover, the engagement of actuator fingers 16*c* and 16*d* with springs 40 holds the detent block assemblies firmly in place within the respective apertures in support plate 36.

It will be noted in FIG. 4 that no upstanding posts similar to 36*e* are provided in the center portion of support plate 36 to cooperate with the respective journals 20 at the center of cover 4. This area is intentionally left open to permit the switching apparatus to be appropriately back lit where desired. As will be described in greater detail hereinafter, a light pipe 42 or a bearing block 44 are trapped between the interior of the cover 4 and support plate 36. Light pipe 42 is provided with a rectangular recess 42*a* and bearing block 44 is provided with a rectangular recess 44*a* in their respective upper surfaces adjacent the cover 4 to overlie the respective center journals 20, thereby closing off the open sides of the journals.

Convenience switch packages such as the package 2 of this invention, particularly when utilized in a passenger car, are preferably illuminated to indicate the function or location of the respective switches. It is preferable that the illumination be in the form of back lighting which can be readily matched to the instrumentation lighting scheme within the respective vehicle. To this end, the switch apparatus of this invention provides windows such as 4*e* and 4*f* in cover 4 and a molded transparent light pipe 42 having transverse bars 42*b* and 42*c* (FIGS. 2 and 3) aligned with the windows 4*e* and 4*f*, respectively. Indicia bearing films 46 and 48 are positioned between the cover and the cross bars 42*b*, 42*c* to be visible in the respective windows 4*e* and 4*f*. The central body of light pipe 42, which extends longitudinally between switches 8 and 10, has a hole 42*d* formed therein for receiving a lamp or LED 50 to provide illumination to the light pipe. The lamp 50 is provided on a microprocessor board 52 which will be described hereinafter and projects upwardly through hole 26*c* in base 26, hole 28*c* in planar switch 28, hole 34*a* in conductive rubber sheet 34 and hole 36*e* in detent support plate 36, all of which are aligned with hole 42*d* in light pipe 42. The opposite ends of the light pipe are provided with V-shaped notches 42*e* and 42*f* to reflect light rays within the central body of the light pipe outwardly along transverse bars 42*b* and 42*c*, respectively. The lower surfaces of the transverse bars are provided with serrations for evenly dispersed diffraction of the light within the respective transverse bars.

When illumination is desired at the right-hand side of switches 12 and 14, the light pipe 42 may be made to extend along the full length of the cover 4. However, in the embodiment illustrated, illumination at the right-hand side of switches 12 and 14 is not required and therefore a bearing block 44 is secured between the interior surface of cover 4 and support plate 6 solely for the purpose of closing off the open bottom of journals 20 and providing a bottom bearing surface for the trunnions 18 of actuators 16 associated with switches 12 and 14.

As seen in FIG. 2, the sides and one end wall of cover 4 extend downwardly beyond the base 26 to provide a skirt area for mounting and protecting the microprocessor board 52. Referring to FIGS. 2 and 4, the microprocessor board has a plurality of components affixed on both the upper and lower surfaces, the lower surface having a microprocessor 54, various chips for functions such as sensors, relay drivers and power supply protection and filtering, multi-pin connectors such as 60 and 62, and the like affixed thereto while the upper surface has various resistors and capacitors surface mounted thereon. The lamp 50 has its leads connected in the circuitry of the microprocessor board and projects upwardly therefrom to extend through the aforementioned aligned holes into the light pipe 42. Board 52 has a plurality of lateral tabs 52*a* which extend into corresponding holes 4*g* in the side walls of cover 4 to secure the microprocessor board 52 in place. The connection between planar switch 28 and microprocessor board 52 is made through the ribbon conductor 28*a* which extends between the side wall of cover 4 and base 26 and microprocessor board 52 out the bottom of the switch assembly and is then rolled upwardly and plugged into the multi-pin connector 62 on board 52. It should be recognized that the printed circuit of planar switch 28 could be applied directly to the upper surface of base 26 and the circuitry and components of microprocessor board 52 could be incorporated directly on the lower surface of base 26, connecting the switching printed circuit to the microprocessor printed circuit directly by vias or plated through holes when the same can be justified by economy of scale.

Referring next to FIGS. 5–8, the conductive rubber block in the form of boss 34*a* shown in FIG. 5, is offset upwardly from the bottom surface of rubber sheet 34 to provide a small space over conductive elements 28*d* and 28*e* forming the switch contacts. Boss 34*a* extends upwardly through hole 38*b* in detent block 38 which is disposed within aperture 36*a* of detent support plate 36. The slots 38*c* fix the opposite ends of leaf spring 40 at a predetermined angle such that it spans the intermediate recessed portion of block 38, the spring being bowed upwardly, spaced from the conductive rubber block 34*a* a predetermined amount. Finger 16*c* of actuator 16 bears upon the upper surface of spring 40 substantially at the crest of its bowed area, but somewhat offset from the true center. Similarly, finger 16*d* bears upon the upper surface of the spring 40 of detent block 38 which is disposed within aperture 36*b* located in the background as viewed in FIG. 5. Inasmuch as the switches 8–14 are double pole, double throw switches, springs 40 bias actuator 16 to its center position and the centering springs 24 may be omitted.

Figure 6:
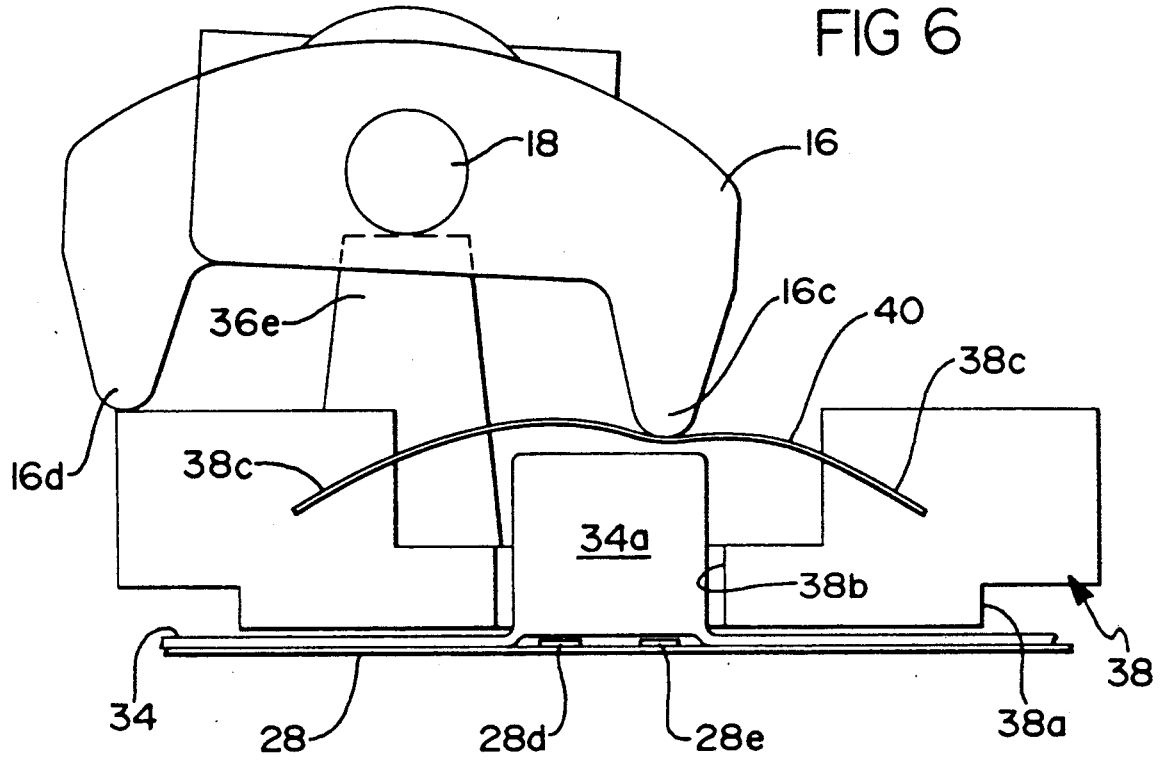
FIGS. 6, 7 and 8 are semi-schematic views of the switch, detent and a portion of the actuator as viewed in FIG. 5, but drawn to a still greater scale, sequentially depicting actuation of the switch.
Figure 7:
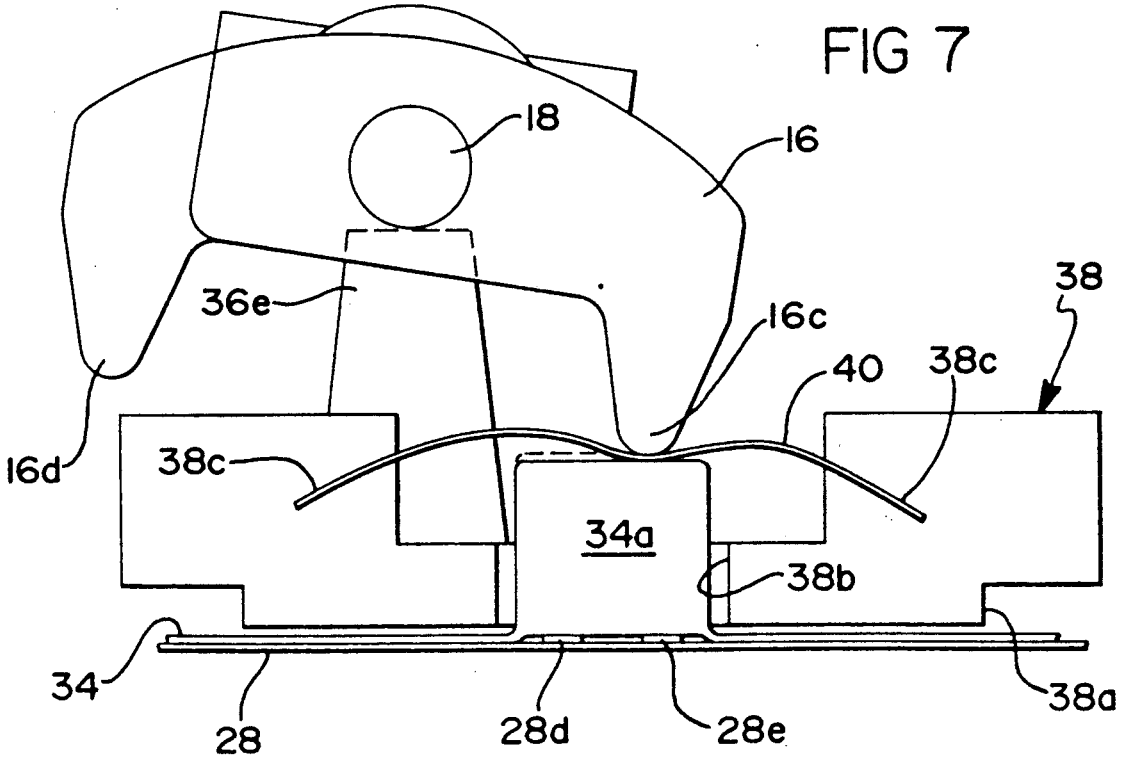
Figure 8:
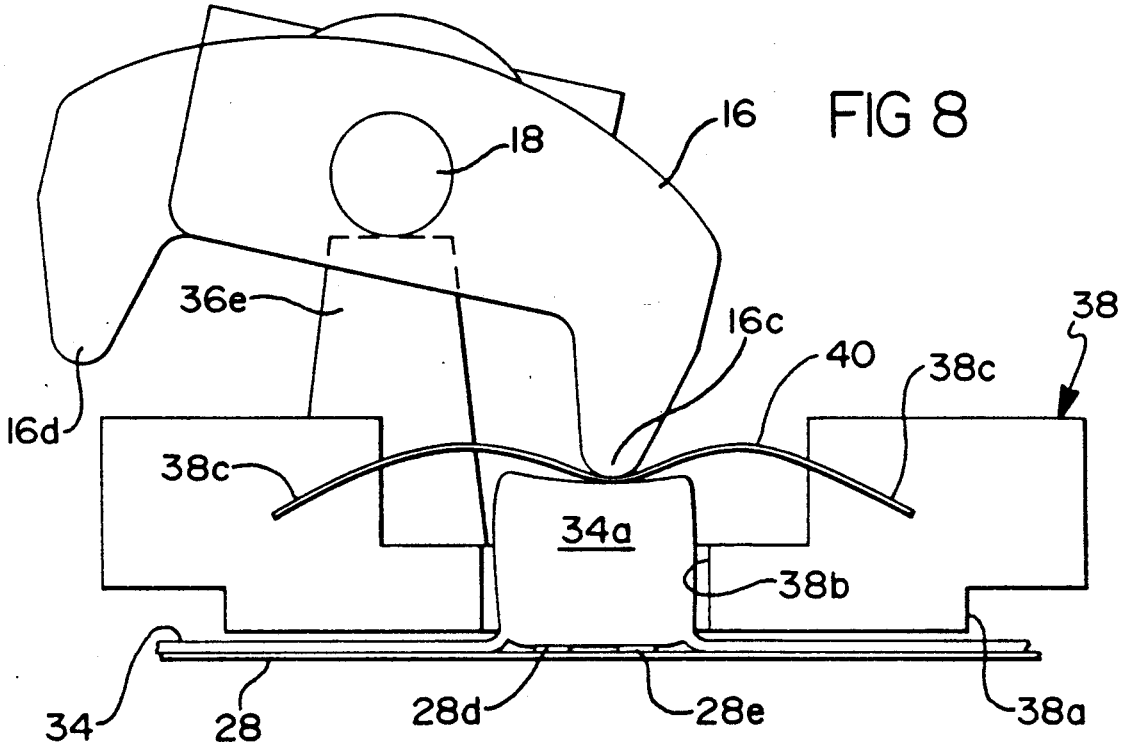

As the actuator 16 is pivoted from its center position shown in FIG. 5 to a second position such as clockwise as shown in FIGS. 6 and 7, the tip of finger 16c translates arcuately downward and to the left along the upper surface of spring 40 to deflect the intermediate portion of that spring from an upwardly bowed, convex condition to a reversed, downwardly bowed, concave condition as can be seen to be starting in FIG. 6 and is shown successively in FIGS. 7 and 8. The spring 40 is driven into engagement with the upper surface of boss 34a (FIG. 7) and thereafter compresses the boss 34a against the stationary contact elements 28d, 28, (FIG. 8), establishing bridging current conduction (switching) therebetween. As indicated previously, spring 40 applies a return bias to actuator 16, resisting the movement of actuator 16 from the center position (FIG. 5) to the clockwise second position (FIG. 8). This movement is also opposed by the rubber boss 34a after it is engaged by finger 16c through spring 40. The force of spring 40 resisting this movement increases throughout approximately the first half of travel of operator button 22 and changes to a decreasing force at a point in the actuator travel preceding, but substantially concurrent with, the establishment of current conduction (switching) between contact elements 28d and 28e. The resistive force applied to the operator 22 through actuator 16 by spring 40 and rubber boss 34a is depicted at curve 64 in the force versus displacement graph shown in FIG. 11. As can be seen, the changeover point B from an increasing force to a decreasing force occurs at approximately 1.5 millimeters in operator/actuator travel. The point at which current conduction is established between elements 28d and 28e (switching point) is a band S at between 1.7 and 1.9 millimeters in travel. It is desirable to have the force changeover point B slightly precede or be concurrent with the switching point so that the operator can sense actuation of the window.

The use of an elastomer as a switch making and breaking element contacted by the actuator also provides cushioning and sound deadening for the switching apparatus. No audible clicks occur from the mechanism as a result of the spring 40 changing from a convex to concave condition or the actuator finger 16c sliding along the surface of the spring 40. The resiliency of boss 34a creates little or no sound as spring 40 abuts the upper surface, and as the boss engages the contacts 28d and 28e. The travel of actuator 16 is positively limited by abutment of the right-hand end of rocker button 22 with cover 4, at which time the external force on the button increases steeply as shown at T on the curve. The slope of this portion of the curve can be made to be a more gentle slope by decreasing the stiffness of the rubber. If the rubber boss 34a is sufficiently stiff, for example, it can arrest actuator movement before the rocker button 22 strikes cover 4, eliminating noise of such impact.

Figures 12, 13:
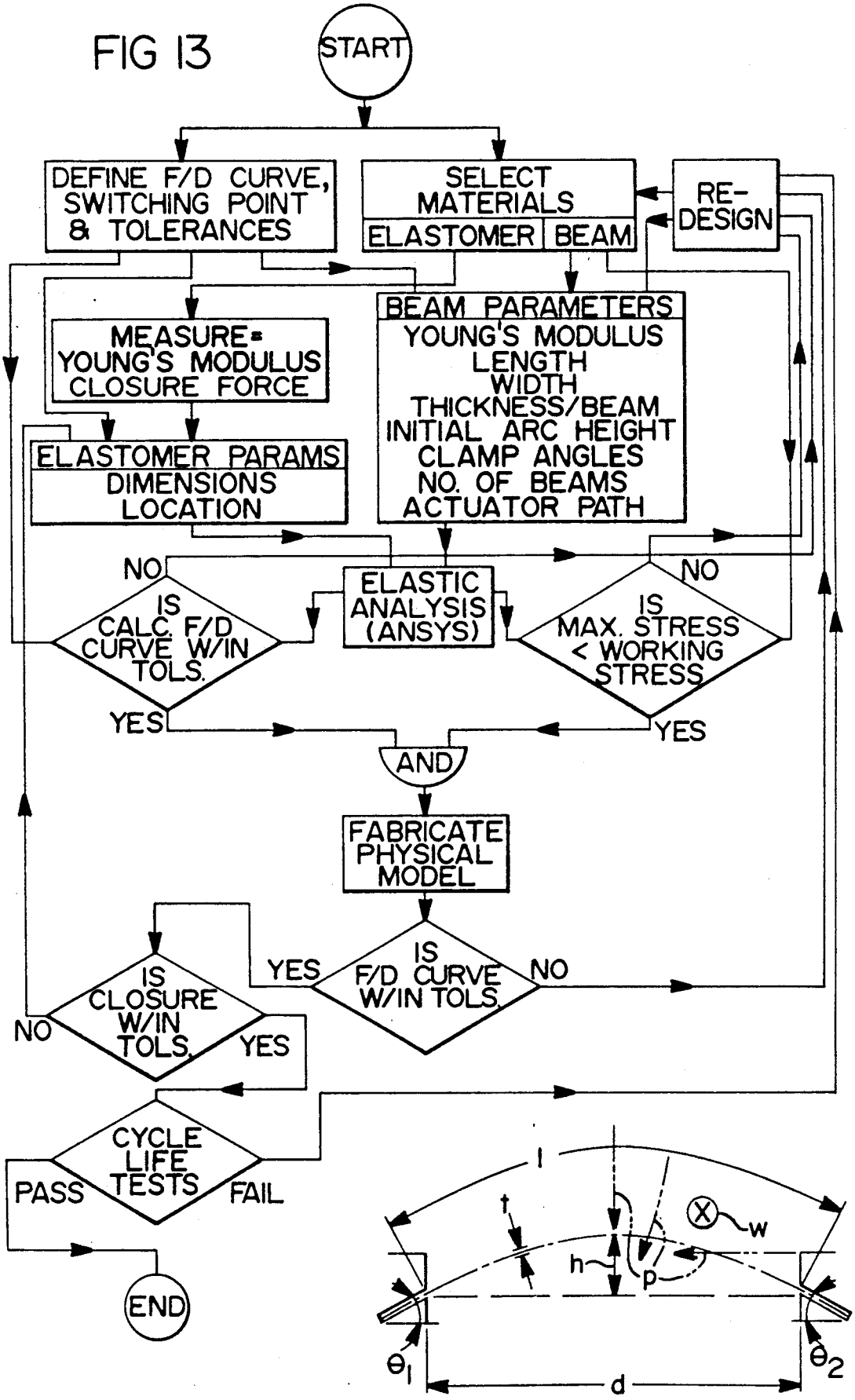
FIG. 12 is a schematic view of the beam spring and end supports of this invention illustrating certain parameters utilized in the construction of the detent assembly thereof.
FIG. 13 is a flow chart diagram representing the process for designing and changing the detent assembly to produce different tactile feedback characteristics thereof.

A major advantage of this invention is the ability to readily redesign the detent block 38 and/or spring 40 to obtain a desired force versus displacement curve, therefor satisfying changing specifications. Using standard beam analysis such as in Marks Engineering Handbook-Mechanical Engineering sections or following the Bernoulli-Euler Law and assuming thin beam approximation, i.e. the length of the beam remains constant throughout its movement, simple design relationships can be derived to relate a change in geometric parameter to a desired affect on the force versus displacement curve. With reference to FIG. 12, the following parameters are utilized in the beam design:

| |
|---|
| material (Young's modulus) |
| l = length (length along beam between supports) |
| d = distance (between supports) |
| w = width (dimension into paper) |
| t = thickness (of the individual beam) |
| h = height (initial arc height) |
| $\theta 1, \theta 2$ = clamp angles (beam ends) |
| n = number of beams |
| p = actuator travel path (arcuate, normal, cammed) |

Also considered in the overall design of the detent structure are certain parameters of the rubber block, e.g. boss 34a, that is compressed on the conductive segments 28d, 28e to effect switching. The Young's modulus of the rubber, Poisson's ratio, pressure required to achieve current conduction between the conductive segments 28d, 28e, the dimensions of the block, its location with respect to spring 40 and the constraints that position it above the conductive segments 28d, 28e, are each such parameter.

With reference to FIGS. 11 and 13, the design is determined with an elastic analysis software program such as ANSYS (trademark of Swanson Analysis Systems, Inc.), a self-contained general purpose finite element analysis program. Due to the simplicity of the configuration, it is recognized that simpler software tools can be developed specifically dedicated to this task, but such development is not dealt with herein. The design is initiated by defining a target force versus displacement curve F/D such as 64 using the specifications, switching point S and tolerances provided by the customer. The materials of the rubber (block 34a) and the beam (spring 40) are selected. The rubber is measured to determine its Young's modulus and the force necessary to effect switching. Parameters of the rubber, namely, the aforementioned dimensions and location, are inputted to the elastic analysis program. The location of the upper surface of the rubber block is defined by the earliest allowable closure (switching) point in the travel. The dimensions of the rubber block are selected from Young's modulus, the force required to effect closure (switching), the latest allowable closure point in the travel, and the desired rubber restoring force that combines to the overall F/D curve. Also inputted to this program are the beam parameters defined above in conjunction with the defined F/D curve. Certain of the beam parameters are given. Using scaling equations developed from simple beam spring theory, reasonable choices to one skilled in the art are selected for the unknown or unestablished parameters. The program produces outputs that are compared to the F/D curve for compliance with the permitted tolerances. If not, it cycles to a redesign mode for changes in selected parameters. Another output of the analysis program compares the maximum stress of the beam to the working stress known from the selected material to determine that the maximum stress is less than the working stress. If not, the program cycles to the redesign mode.

If yes answers are obtained from both output comparisons, a physical model of the switch and detent structure are fabricated. The physical model is tested and compared to the F/D curve, and if it does not meet the tolerances of the curve, redesign is required. If it does fall within the F/D curve, it is then checked to determine that switching point S is within the tolerances. If these tolerances are not met, the dimensions and/or location of the rubber block are re-analyzed, changes selected and new parameters of the rubber block are again fed into the program. When yes answers are obtained to both of the latter comparisons, the switch and detent structure are subjected to cycle life tests to finalize the design.

When the basic design is established, new designs to meet different F/D curves can be readily accomplished by variations in one or a few of the parameters. As mentioned hereinabove, the Bernoulli-Euler Law which states that $$E \cdot I \cdot \text{Curvature} = \Sigma \text{ moments}$$

at all points along the beam where

E = Young's modulus

I = Area moment of inertia about the neutral axis of the beam $$\text{curvature} = \frac{y''}{[1 + (y')^2]^{3/2}} \text{ where } y'' = \frac{d^2y}{dx^2}.$$

Scaling laws general to any beam clamped in some manner can be developed from the foregoing, and used in practical design tradeoffs.

Assume, for example, an initial design has been developed and some change is required to increase the force. In general, a force is specified by the customer in terms of specific travel. This is equivalent to specifying a stiffness (force÷travel). The scaling laws for beams of uniform width and thickness are:

$$1.\ \frac{\text{force}}{\text{travel}} \text{ is prop. to } E \cdot W \cdot n \left(\frac{t}{l}\right)^3$$

where:

E = Young's modulus

W = beam width n = number of beams t = beam thickness l = beam length $$2.\ \text{maximum stress in prop to } Ey\left(\frac{t}{l^2}\right).$$

As an example, if it is desired to reduce stress and increase force for the same amount of travel and same beam material, then $$3.\ \frac{\text{force(new)}}{\text{force(old)}} = R > 1$$

and $$4.\ \frac{\text{stress(new)}}{\text{stress(old)}} = r < 1.$$

Then, $$5.\ \frac{w(\text{new})n(\text{new})}{w(\text{old})n(\text{old})}\left(\frac{t(\text{new})l(\text{old})}{l(\text{new})t(\text{old})}\right)^3 = R$$

-continued and $$6.\ \frac{t(\text{new})l^2(\text{old})}{t(\text{old})l^2(\text{new})} = r.$$

Substituting (6) into (5):

$$\frac{w(\text{new})n(\text{new})}{w(\text{old})n(\text{old})}\left(r\frac{l^2(\text{new})}{l^2(\text{old})} \cdot \frac{l(\text{old})}{l(\text{new})}\right)^3 = R$$

resulting in $$\frac{w(\text{new})}{w(\text{old})} \cdot \frac{n(\text{new})}{n(\text{old})}\left(\frac{l(\text{new})}{l(\text{old})}\right)^3 = \frac{R}{r^3} > 1$$

This method trades-off either the width w, length l or number of beams n to achieve desired results. In the resulting equation above, thickness was eliminated from the initial solution. Therefore, thickness must subsequently be calculated from the formula. Alternately, length could have been eliminated to calculate thickness t in which case l would need to be subsequently calculated from the equation:

$$\frac{w(\text{new})}{w(\text{old})} \cdot \frac{n(\text{new})}{n(\text{old})}\left(\frac{t(\text{new})}{t(\text{old})}\right)^{3/2} = \frac{R}{r^{3/2}}.$$

Figure 9:
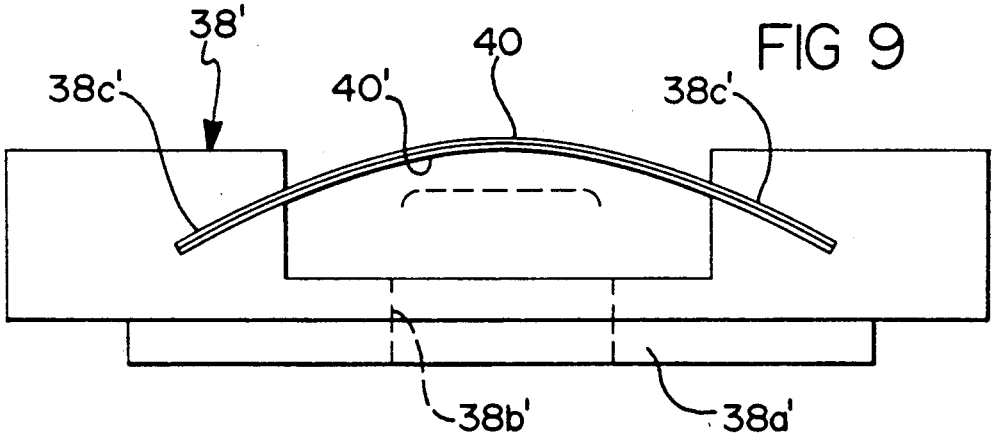
FIG. 9 is a side elevation view of an alternate detent block assembly incorporating a plurality of flat beam leaf springs stacked upon each other.
Figure 10:
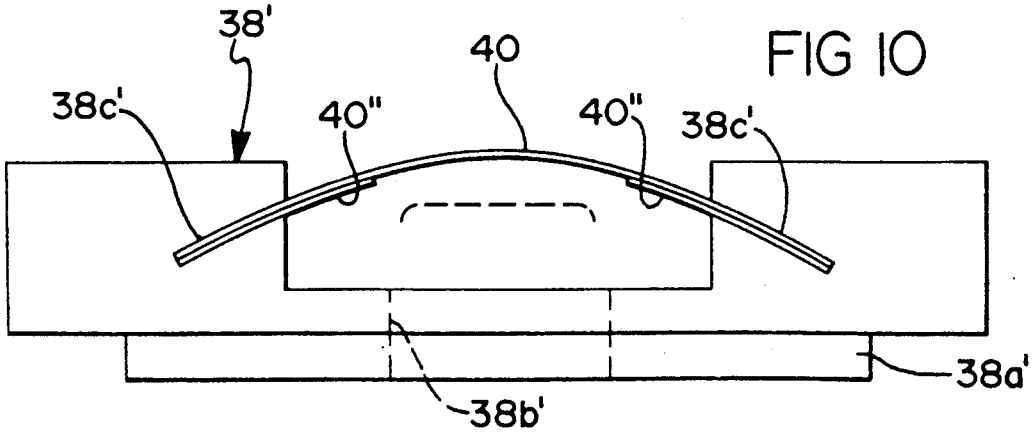
FIG. 10 is a side elevation view of another alternate detent block assembly similar to FIG. 9 incorporating stub springs stacked at each end of a full beam spring.

Thus, the thickness t of the spring 40 may be changed, the length l may be changed giving rise to an increased height h of the arc, etc. As seen in FIG. 9, one or more additional spring 40' may be used, with the thickness of the slots 38c' correspondingly increased. To avoid an inventory of blocks having different thickness slots 38c', the slots can be standardized to accommodate the multiple thickness and shims such as stub springs 40'' (FIG. 10).

The low current switching apparatus described hereinabove provides the size, shape and feel of state of the art power current switching devices for similar applications, but switches signals at microprocessor levels to enable the switch to be used in a multiplexing application, thereby providing the OEM customer the advantages of multiplexing. The modular detent enables the tactile feedback of the switch to be changed readily and quickly during manufacture, to satisfy varying requirements. The switching apparatus incorporates a layered assembly concept for economic advantage in assembly, including a light pipe layer where specified. Although the switch has been shown in a preferred embodiment, it is to be understood that it is susceptible of various modifications without departing from the scope of the appended claims.

I claim:

1. Low current switching apparatus comprising, in combination:

spaced stationary conductive elements;

a conductive member overlying said stationary conductive elements in spaced relation thereto;

an operator movable from a first position to a second position effecting depression of said conductive member into bridging current conducting relation with said stationary conductive elements; and detent means comprising:

a normally planar flat beam leaf spring distinct from said conductive member;

means fixing opposite ends of said leaf spring, supporting said leaf spring in a bowed, flexed condition; and means on said operator bearing upon an intermediate portion of said leaf spring deflecting said intermediate portion from a convex condition to a concave condition upon movement of said operator from said first position to said second position, said leaf spring initially applying an increasing force to said operator resisting said operator movement and changing to a decreasing force at a predetermined point in said movement to provide tactile feedback to said operator.

2. Low current switching apparatus as defined in claim 1 wherein said bowed condition of said leaf spring does not exceed an elastic limit thereof.

3. Low current switching apparatus as defined in claim 1 wherein said means fixing opposite ends of said leaf spring produce no residual stress in said leaf spring.

4. Low current switching apparatus as defined in claim 1 wherein said leaf spring continuously provides a bias to said operator to return said operator to said first position in both said convex an concave condition.

5. Low current switching apparatus as defined in claim 3 wherein said opposite ends of said leaf spring are fixed at mutually intersecting angles defining an obtuse angle therebetween.

6. Low current switching apparatus as defined in claim 1 wherein said force of said leaf spring is predictably varied by providing a selected width and a selected thickness for said flat beam leaf spring to provide a desired tactile feedback.

7. Low current switching apparatus as defined in claim 1 wherein said operator is pivotally movable and said means on said operator bearing upon said intermediate portion of said leaf spring is arcuately movable from said first position to said second position providing translational movement thereof along said spring concurrently with deflection to said concave condition.

8. Low current switching apparatus as defined in claim 1 wherein said predetermined point precedes or is substantially concurrent with said conductive member effecting said bridging current conducting relation with said stationary conductive elements.

9. Low current switching apparatus as defined in claim 1 wherein said conductive member comprises an elastomeric member compressed into current conducting relation with said stationary conductive elements by said operator.

10. Low current switching apparatus as defined in claim 9 wherein said elastomeric member provides a force which combines with said force provided by said spring to bias said operator toward said first position.

11. Low current switching apparatus as defined in claim 10 wherein parameters consisting of material, length, width, and thickness of said spring, distance between fixed ends of said spring, angular fixation of said ends of said spring, height of said bowed condition of said spring, number of springs, and operator path of travel may be selectively varied to provide a predetermined force versus displacement curve of force applied to said operator in relation to position of said operator.

12. Low current switching apparatus as defined in claim 11 wherein said parameters further consist of dimensions, location and Young's modulus of said elastomeric member, and pressure required to effect said current conducting relation with said stationary conductive elements.

13. Low current switching apparatus comprising a multiple layer assembly comprising, in combination:

a first layer comprising a rigid insulating base;

a second layer comprising a printed circuit having spaced conductor elements defining switch contacts;

a third layer comprising an insulator covering said printed circuit and having an opening aligned with said switch contacts;

a fourth layer comprising a block of conductive rubber overlying said switch contacts in spaced relation thereto;

a fifth layer comprising a rigid insulating detent support having an aperture aligned with said block and said switch contacts;

said first through fifth layers being secured in a sandwich relation by a cover enveloping said layers and being attached to said base;

detent means comprising a flat beam leaf spring;

means on said detent support fixing opposite ends of said leaf spring at respective opposite sides of said aperture, said leaf spring being disposed over said aperture and being bowed toward said cover away from said block;

switch actuator means pivotally mounted in said cover having an operator portion extending externally of said cover, movement of said actuator means from a first position to a second position effecting compression of said conductive rubber block into current conducting bridging relation with said switch contacts; and means on said actuator means bearing upon an intermediate portion of said leaf spring deflecting said intermediate portion from a convex to a concave shape during said movement of said actuator means, said leaf spring initially applying an increasing force to said actuator means resisting said movement and changing to a decreasing force at a predetermined point in said movement, thereby providing tactile feedback to said operator.

14. Low current switching apparatus as defined in claim 13 wherein said means on said detent support fixing opposite ends of said leaf spring comprises a pair of slots disposed at mutually intersecting angles defining an obtuse angle therebetween.

15. Low current switching apparatus as defined in claim 14 wherein said means on said detent support fixing opposite ends of said leaf spring comprises an insulating block having a recessed intermediate section defining upstanding end portions, a pair of slots formed in respective opposed faces of said end portions, said slots being open to opposite sides of said block, said slots further being disposed at intersecting angles defining an obtuse angle therebetween, and a hole through said intermediate section, opposite ends of said leaf spring being received in said slots, said block being positioned on said detent support over said aperture, said conductive rubber block projecting through said hole in said intermediate section.

16. Low current switching apparatus as defined in claim 15 wherein said detent support comprises structural formations cooperating with said insulating block for locating said insulating block on said detent support.

17. Low current switching apparatus as defined in claim 16 wherein said structural formations comprise recesses adjacent opposite ends of said aperture, said insulating block being received in said recesses and aperture.

18. Low current switching apparatus as defined in claim 16 wherein double pole, double throw switching apparatus is provided comprising a second aperture in said support plate offset from said first defined aperture, second switch contacts, a second opening in said insulator and a second block of conductive rubber all aligned with said second aperture, a second flat beam leaf spring supported in a bowed condition over said second aperture in a second said insulating block providing a second detent means, and second means on said actuator means bearing upon an intermediate portion of said second leaf spring deflecting said intermediate portion of said second leaf spring from a convex to a concave shape during movement of said actuating means from said first position to a third position directionally opposite said movement to said second position, said second leaf spring initially applying an increasing force to said actuator means resisting said movement to said third position and changing to a decreasing force at a predetermined point in said movement to said third position, thereby providing tactile feedback to said operator.

19. Low current switching apparatus as defined in claim 18 comprising multiple switches within said apparatus, each having respective switch contacts, a respective opening in said insulator, a respective conductive rubber block, a respective detent means and a respective actuator means, said respective detent means comprising a plurality of said insulating blocks each containing a respective said flat beam leaf spring, and said detent support comprising a corresponding plurality of apertures arranged singly or in offset pairs, each aperture having said recesses adjacent opposite ends, and said insulating blocks being received in the respective recesses and apertures.

20. Low current switching apparatus as defined in claim 13 further comprising a sixth layer comprising a light pipe disposed adjacent an internal surface of said cover, said light pipe having portions aligned with corresponding indicia-bearing windows in said cover and a hole for receiving light source.

21. Low current switching apparatus as defined in claim 20 wherein pivotal mounting of said switch actuator means comprises an axle on said switch actuator means received within journals provided in said cover, said journals being open toward said detent support, said detent support comprising an upstanding bearing post aligned with one of said journals, a distal end of said post closing said open side of said one of said journals, and said light pipe having means overlying an opposite one of said journals closing said open side of said opposite one of said journals.

22. Low current switching apparatus as defined in 13 wherein pivotal mounting of said switch actuator means comprises an axle on said switch actuator means received within journals provided in said cover, said journals being open toward said detent support; and said detent support comprises upstanding bearing posts aligned with said journals, distal ends of said bearing posts closing said open side of said journals.

23. Low current switching apparatus as defined in claim 13 wherein said predetermined point precedes or is substantially concurrent with compression of said rubber block an amount adequate to effect bridging current conduction between said switch contacts.

24. Low current switching apparatus comprising, in combination:

an insulating base;

a printed circuit supported by said base, said circuit having a pair of spaced conductive elements defining switch contacts;

insulating means covering said printed circuit having an opening aligned with said switch contacts;

a thin member disposed over said insulating means positioning a conductive rubber block on said insulating means over said switch contacts in spaced relation thereto;

a detent support plate disposed on said thin member, said plate having an aperture aligned with said switch contacts, said conductive rubber block extending through said aperture;

detent means comprising a flat beam leaf spring and means fixedly mounting opposite ends of said leaf spring at respective opposite sides of said aperture, said leaf spring extending across said aperture bowed away from said rubber block;

an insulating cover attached to said base, said cover and said base constituting an insulating housing;

an actuator pivotally mounted in said housing having an operator portion extending through said cover, said actuator being movable from a first position to a second position effecting compression of said conductive rubber block upon said switch contacts, thereby establishing bridging current conduction between said switch contacts; and means on said actuator bearing upon an intermediate portion of said bowed leaf spring, said leaf spring biasing said actuator to said first position and resisting said movement to said second position, said means deflecting said intermediate portion of said leaf spring during said movement, said intermediate portion changing from a convex to a concave shape, said spring initially increasing force resisting said movement and changing to a decreasing force at a predetermined point in said movement substantially concurrently with the establishment of current conduction between said switch contacts, thereby providing tactile feedback to said operator.

25. Low current switching apparatus as defined in claim 24 wherein said means fixedly mounting said opposite ends of said leaf spring comprises a block of insulating material having a reduced thickness center section, a pair of upstanding end portions, a hole through said center section, and a pair of slots formed in respective opposing faces of said upstanding end portions, said slots extending through said block from side to side and oriented at intersecting angles defining an obtuse angle, said opposite ends of said spring being received in respective said slots, and said support plate and said insulating block being provided with cooperating locating means for positioning said detent means relative to said switch contacts.

26. Low current switching apparatus as defined in claim 25 wherein said apparatus is a double pole, double throw switching device comprising a second aperture in said support plate offset from said first defined aperture, and second switch contacts, second opening in said insulating means, and second conductive rubber block all aligned with said second aperture, a second detent means comprising a second flat beam spring supported in bowed condition in a second insulating block positioned by cooperating locating means on said support plate over said second aperture, and second means on said actuator bearing upon an intermediate portion of said second leaf spring deflecting said intermediate portion of said second leaf spring from a convex to a concave shape during movement of said actuator from said first position to a third position directionally opposite said movement to said second position, said second leaf spring initially applying an increasing force to said actuator resisting said movement to said third position and changing to a decreasing force at a predetermined point in said movement to said third position, thereby providing tactile feedback to said operator.

27. Low current switching apparatus as defined in claim 26 wherein said housing contains a plurality of actuators, two of said actuators disposed side by side for coaxial pivotal movement, said actuators each comprising oppositely directed trunnions received in corresponding journals in said cover, said journals being open toward said detent support plate, said support plate having upstanding bearing posts aligned with respective outer ones of said journals, distal ends of said posts closing said open sides of said outer ones of said journals, and further comprising a light pipe disposed against an interior surface of said cover between said two actuators, said light pipe comprising means overlying adjacent ones of said journals closing said open sides thereof.

28. Low current switching apparatus as defined in claim 27 wherein said light pipe comprises a transparent plastic molding disposed lengthwise between adjacent actuators and having at least one transverse arm aligned with a window in said cover, and an indicia-bearing plate disposed between said window and said transverse arm.

29. Low current switching apparatus as defined in claim 24 wherein said printed circuit comprises a flexible backing member having said circuit printed directly thereon.

30. Low current switching apparatus as defined in claim 29 wherein said cover envelopes said base and extends below said base, and said switching apparatus further comprises a microprocessor module board mounted within said cover below said base, and means connecting said printed circuit to said microprocessor board.

31. A detent providing a tactilely discernible change in force to a movable member comprising, in combination:

a normally planar flat beam leaf spring;

means fixing opposite ends of said leaf spring, supporting said leaf spring in a bowed, flexed condition;

a movable member movable from a first position to a second position; and means on said movable member bearing upon an intermediate portion of said leaf spring deflecting said intermediate portion from a convex condition to a concave condition upon movement of said movable member from said first position to said second position, said leaf spring initially applying an increasing force to said movable member resisting said movement and changing to a decreasing force at a predetermined point in said movement to provide tactile feedback to said movable member, wherein said force of said leaf spring is predictably varied by providing a selected width and a selected thickness for said flat beam leaf spring to provide a desired tactile feedback.

32. A detent as defined in claim 31 wherein parameters consisting of material, length, width, and thickness of said spring, distance between fixed ends of said spring, angular fixation of said ends of said spring, height of said bowed condition of said spring, number of springs, and movable member path of travel may be selectively varied to provide a predetermined force versus displacement curve of force applied to said movable member in relation to position of said movable member.

33. A detent as defined in claim 32 wherein said parameters further consist of dimensions, location and Young's modulus of said elastomeric member, and pressure required to effect said current conducting relation with said stationary conductive elements.

34. A detent providing a tactilely discernible change in force to a movable member comprising, in combination:

a normally planar flat beam leaf spring;

means fixing opposite ends of said leaf spring, supporting said leaf spring in a bowed, flexed condition;

a movable member movable from a first position to a second position; and means on said movable member bearing upon an intermediate portion of said leaf spring deflecting said intermediate portion from a convex condition to a concave condition upon movement of said movable member from said first position to said second position, said leaf spring initially applying an increasing force to said movable member resisting said movement and changing to a decreasing force at a predetermined point in said movement to provide tactile feedback to said movable member, wherein said movable member comprises a switch operator effecting actuation of switch contacts when moved from said first position to said second position, said switch contacts being distinct from said flat beam leaf spring.

35. A detent as defined in claim 34 wherein said switch contacts comprise spaced stationary conductive elements and a conductive member overlying said stationary conductive elements in spaced relation thereto; and said operator effects depression of said conductive member into bridging current conducting relation with said stationary conductive elements.

36. A detent as defined in claim 35 wherein said conductive member comprises an elastomeric member compressed into current conducting relation with said stationary conductive elements by said operator.

37. A detent as defined in claim 36 wherein said elastomeric member provides a force which combines with said force provided by said spring to bias said operator toward said first position.

* * * * *